United States Patent [19]

Tymkewicz et al.

[11] Patent Number: 4,538,515

[45] Date of Patent: Sep. 3, 1985

[54] PRINTING MACHINE WITH PROGRAMMED CONTROL OF PRINT CYLINDER MOTOR AND WEB TRACTOR FEED MOTOR

[75] Inventors: John Tymkewicz, Fairview Park; Robert L. Phillips, Cleveland; Richard M. Park, Parma, all of Ohio

[73] Assignee: Marlin Manufacturing Corporation, Cleveland, Ohio

[21] Appl. No.: 657,042

[22] Filed: Oct. 2, 1984

Related U.S. Application Data

[63] Continuation of Ser. No. 484,683, Apr. 13, 1983, abandoned.

[51] Int. Cl.[3] ..... B41F 5/00

[52] U.S. Cl. ..... 101/216; 101/226; 400/616.1; 364/469

[58] Field of Search ..... 101/216, 217, 219, 228, 101/225, 232, 248, 328, 176, 178, 181, 138, 288; 400/616.1, 902; 226/170, 174, 178; 318/309-310; 324/172; 364/469, 472

[56] References Cited

U.S. PATENT DOCUMENTS

| | | | |
|---|---|---|---|
| 3,539,085 | 11/1970 | Anderson et al. | 226/228 |
| 3,552,308 | 1/1971 | Minehart | 101/248 X |
| 3,559,568 | 2/1971 | Stanley | 101/219 X |
| 3,648,911 | 3/1972 | Pekrui | 101/225 |
| 3,934,505 | 1/1976 | Kushner | 101/248 X |
| 4,030,720 | 6/1977 | Jones | 400/902 |
| 4,066,015 | 1/1978 | Polko | 101/228 |
| 4,066,016 | 1/1978 | Tison | 101/219 X |
| 4,135,447 | 1/1979 | Barnes et al. | 101/178 X |
| 4,205,770 | 6/1980 | Wojdyla | 101/228 X |
| 4,220,084 | 9/1980 | Maclean et al. | 324/172 X |
| 4,318,176 | 3/1982 | Stratton et al. | 364/469 |
| 4,334,471 | 6/1982 | Noyes et al. | 101/228 |
| 4,354,766 | 10/1982 | Hendrischk | 400/616.1 X |

FOREIGN PATENT DOCUMENTS

| | | | |
|---|---|---|---|
| 2204357 | 12/1973 | Fed. Rep. of Germany | 101/228 |
| 2440753 | 3/1975 | Fed. Rep. of Germany | 101/228 |
| 70665 | 5/1982 | Japan | 101/228 |

OTHER PUBLICATIONS

"Closed-Loop Stepper Control with Auto Synchronization of Encoder Feedback", IBM Tech. Discl. Bulletin, vol. 24, No. 10, 3/82, pp. 5013-5014.

"Bidirectional Printer Carriage", IBM Tech. Discl. Bulletin, vol. 15, No. 1, 6/72, p. 157.

*Primary Examiner*—E. H. Eickholt

*Attorney, Agent, or Firm*—Watts, Hoffmann, Fisher & Heinke Co.

[57] ABSTRACT

A printing machine for applying marks at specified locations on a moving web. The machine has specific utility in check or document signing applications where a number of forms are successively signed by a signature stamp. In accordance with a preferred embodiment of the invention the machine has one motor for driving a web of paper to a print station and a second motor for activating a stamp by rotating the stamp into contact with the web. The motors are individually energizable under control of a programmable controller. By coordinating the times and duration of motor energization the spacing between successive marks can be varied over a wide range of values. The flexibility in print spacing allows the printing machine to be used in conjunction with the processing stations such as word processing and the like.

6 Claims, 12 Drawing Figures

PRINTING MACHINE WITH PROGRAMMED CONTROL OF PRINT CYLINDER MOTOR AND WEB TRACTOR FEED MOTOR

This application is a continuation, of application Ser. No. 484,683, filed Apr. 13, 1983, and now abandoned.

DESCRIPTION

1. Technical Field

The present invention relates to method and apparatus for applying a mark at one or more locations on a web and is suitable for use on a signature machine where a signature stamp repetitively applies a signature at regular intervals on a paper web.

2. Background Art

Automatic check signing machines are one example of a device which repetitively places a mark at spaced locations on a moving web. The typical check signing machine includes a mechanism for feeding checks of equal size to a print station where a form signature is applied to the checks on a signature line. The spacing between signatures is constant.

Prior art check marking machines moved a series of checks in the form of a paper web toward a print station where a rubber stamp or the like contacted the web. A single drive both moved the paper and actuated the print mechanism. The two were linked together so that each time the web moved a certain distance toward the print station, the print mechanism was actuated and a signature applied to the web. Since the means for moving the web and the print mechanism were physically coupled, the spacing between successive marks on the web never varied so long as no slipping of the web occurred.

The typical prior art print mechanism included a rotatably mounted cylinder having a print die mounted to its exterior. If the speed of rotation of the print cylinder was constant, and the mechanism for moving the print web into a print station was tied to the print cylinder through a mechanical linkage, each rotation of the print cylinder caused a mark to be placed at a regular interval along the web. This spacing equaled the circumference of the print cylinder.

In efforts to enhance the flexibility of these check printing mechanisms, multiple dies or stamps were mounted about the periphery of the print cylinder. If, for example, two dies are located on opposite sides of the cylinder, each rotation of that cylinder causes two marks or signatures to be placed upon the moving web. In a similar manner, these stamps can be placed at other equal intervals i.e. thirds, quarters, etc. so that each print cylinder rotation provides multiple marks on the web. The spacing between marks is still limited, however, to fractions of print cylinder circumferences.

A need exists for greater flexibility in marking indicia on a moving web. One need is the capability to vary the spacing between successive marks over a continuous range of mark spacings. A printing machine which can continuously vary the spacing between adjacent marks could be utilized in a word or data processing environment. The printing machine can be located downstream from a word or data processing machine to receive a web of computer fanfold, for example and selectively incode a mark or indicia on the web. The output from this marking machine, could in turn be routed to other work stations such as an envelope stuffing station. It is appreciated that such an improved printing mechanism could comprise one component of a coordinated advertising and/or mailing operation as well as serving its traditional check signing role.

DISCLOSURE OF THE INVENTION

Practice of the present invention allows spacing between successive marks or indicia (signatures for example) to be varied continuously over a wide range. This feature of the present invention makes automatic signature machines more flexible in use and also opens up the use of these machines for other applications, in particular word processing applications, in which prior art signature machines would be unsuitable.

Apparatus constructed in accordance with the invention includes a drive mechanism for moving a web to a printing station and a print mechanism for applying marks or indicia at the print station. The print mechanism is selectively actuated so that as the web moves past the print station the indicia are applied at controlled locations on the web. The print mechanism is not physically coupled to the mechanism for moving the web so that the spacing between successive marks on the web can be altered and indeed is continuously variable over a wide range of mark separations.

In a preferred embodiment the mechanism for applying the indicia comprises a rubber die mounted to rotate against a platen. Controlled rotation of the die at a speed equal to the speed of web movement towards the print location results in marks appearing at regular intervals on the web. The spacing between successive markings on the webs depends upon the relative coordination between actuation of the die and movement of the web.

If a portion of the web is fed through the print station prior to the actuation of the print mechanism, the spacing between successive print locations can be widened to accommodate different width checks and/or forms. Conversely, if the spacing between successive signatures is to be decreased, the print cylinder is actuated and after a suitable delay the web is moved through the print station. In a preferred embodiment, the spacing between successive signatures can be varied by inputting a desired spacing on a sequence of thumb-wheel switches which allow a user to selectively control the spacing.

The preferred mechanism for moving the web includes a tractor feed driven by a first rotatable shaft coupled to a first stepper motor. A second rotatable shaft driven by a separate stepper motor rotates the rubber die or stamp into contact with the web which is supported by the backing platen. Controlled actuation of the two stepper motors allows the spacing between successive marks on the web to be varied. In particular, the stepper motors are selectively activated by a programmable controller which polls the settings on the thumbwheel switches and automatically produces a stepper motor energization sequence to produce the desired spacing between marks.

Use of a programable controller to provide stepper motor action considerably enhances the flexibility of the present system. The separation between successive marks on the web can be controlled by a second programmable controller communicating with the first. This second programmable controller might control operation of a word processing station so that the positioning of the repetitive marks, such as signatures, can be coordinated with movement of a chain of form letters produced by the word processing station. Use of a programmable controller allows the spacing to be entered in either english or metric units with only minor reprogramming of the programmable controller.

From the above it should be appreciated that one object of the invention is to continuously control the spacing between repetitively placed marks on a moving web. A capability to control this spacing enhances the flexibility of such a printing system and makes that system more adaptable for use in environments other than in check signature printing. These and other objects, advantages, and features of the present invention, will become better understood when a detailed description of a preferred embodiment of the invention is described in conjunction with the accompanying drawings.

BEST MODE FOR CARRYING OUT THE INVENTION

Figure 1:
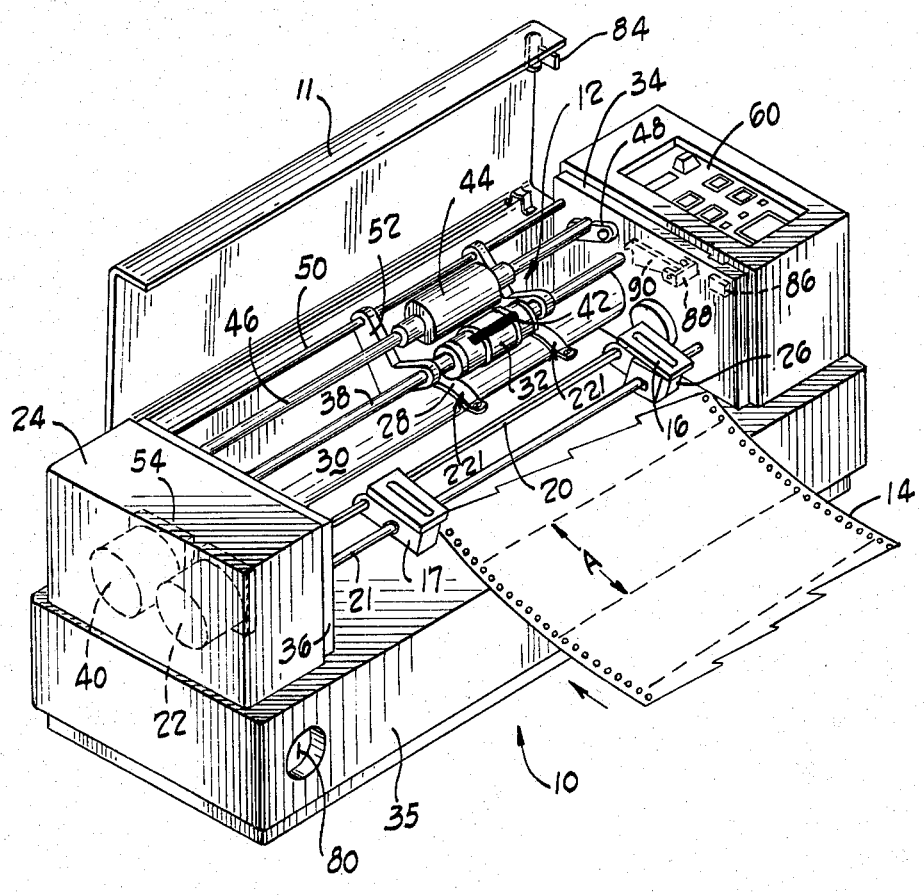
FIG. 1 is a perspective view of a printing machine constructed in accordance with the invention.

Turning now to the drawings, FIG. 1 shows a printing machine 10 constructed in accordance with the present invention. The printing machine 10 is shown with a cover 11 raised to illustrate a printing station 12 where a moving web 14 is encoded with a series or sequence of regularly spaced marks. One application of the present printing machine 10 is to move a series of checks through the printing station 12 so that form signatures may be added to the checks at regular intervals spaced by the width A of each check.

The web 14 is driven by a pair of tractor feed elements 16, 17 which engage holes on either side of the web 14 to move the web toward the print station. Each tractor feed 16, 17 includes a series of teeth (not shown) which engage these holes and drive the web 14 toward the printing station 12 at a speed dependent upon the speed with which the tractor drive teeth engage the web 14.

Figure 2:
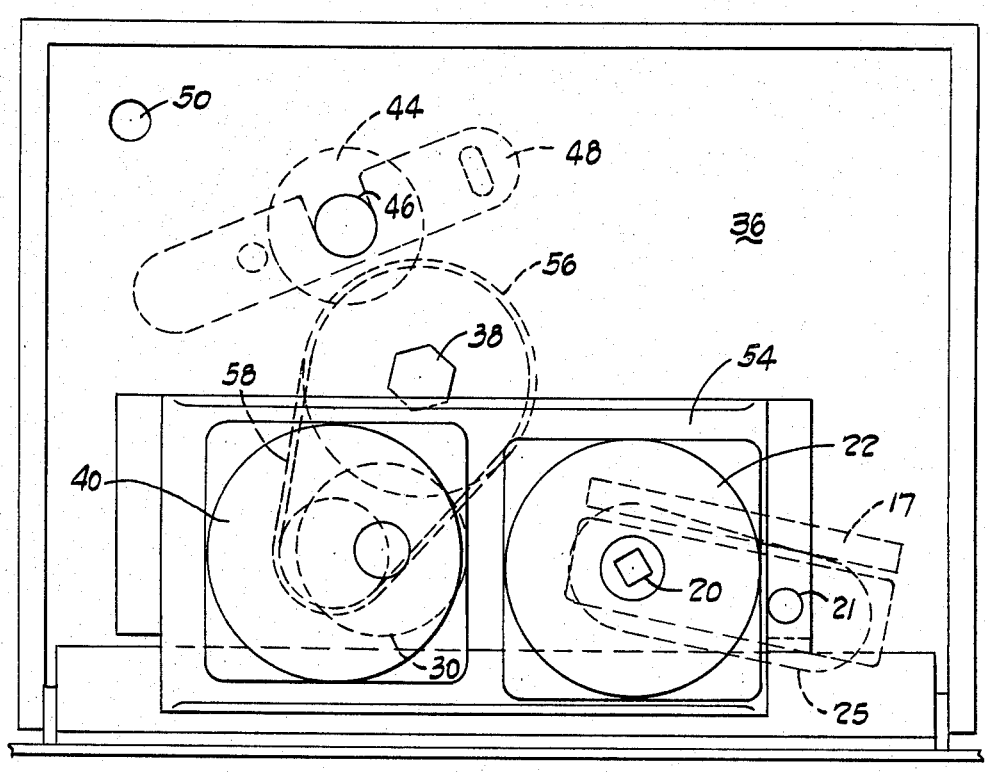
FIG. 2 is an elevational view of the printing machine with a side cover removed.

The tractor teeth are themselves driven by a rotatable shaft 20 coupled to a paper drive motor 22 mounted to the printing machine 10 inside a housing 24. Energization of the drive motor 22 rotates the shaft 20 causing the teeth on the tractor drive to follow an endless loop path 25 (see FIG. 2) at a speed related to the speed of rotation of the shaft 20. The tractor feed 17 nearest the drive motor 22 can be moved along the length of the drive shaft 20 and a support rod 21 to accommodate webs of various widths. The tractor drive 16 furthest from the motor 22, however, is fixed in relation to the drive shaft 20 and rod 21.

An out-of-paper switch 26 to be described in greater detail later is mounted to this stationary tractor feed 16. This switch 26 is coupled to electronics inside a base 35 so it is desirable to fix this tractor feed 16 to avoid damaging the connection between the switch 26 and the electronics. The two tractor feeds 16, 17 are commercially available from Precision Incorporated.

At the printing station 12 the web 14 is directed by a paper guide 28 through a nip defined by a platen roll 30 and a print roll 32. The platen roll 30 is mounted to two end supports 34, 36 for free rotation with respect to those end supports. The supports 34, 36 are mounted to the base 35 which houses electronics for the printing machine 10.

The print roll 32 is fixed to and rotates with a second drive shaft 38 which in turn is coupled to a print motor 40. Rotation of the drive shaft 38 rotates the print roll 32 and a rubber die 42 coupled to the print roll 32. The rubber die 42 can be readily interchanged with the other suitable dies to alter the mark applied to the moving web 14. In one embodiment, for example, the die 42 has a signature pattern so that rotation of the die 42 into contact with the web 14 generates an inked signature which can, for example, be applied to a series of checks moving through the print station. In a preferred embodiment of the invention, each rotation of the drive shaft 38 causes the die 42 to come in contact with the moving web 14 once.

Mounted directly above the print roll 32 is an ink roll 44. As the drive shaft 38 rotates the rubber die 42 into contact with the ink roll 44, ink is applied to the die so that as the die contacts the web a mark is applied. The ink roller 44 is rotatably mounted to a shaft 46 supported by two brackets 48 coupled to the end supports 34, 36. The position of the brackets is adjustable to minimize interference between the die and ink roller while insuring that enough ink is transferred to the die 42.

An additional shaft 50 provides rigidity and stability to the two end supports 34, 36. Coupled to this shaft 50 is a bracket or arm 52 through which the paper guide 28 is connected. The print roll 32, ink roll 44, and paper guide 28 can be all shifted from side to side to adjust the position at which marks are placed on the moving web. The print and ink rolls 32, 44 frictionally engage the shafts 38, 46 so that they can be repositioned without the need for a special tool. Since the platen 30 runs the width of the print station no adjustment in its position is needed. When, for example, the printing machine 10 is applying signatures in a check signing mode of operation, the print station can be manually repositioned to the right side to line up with the traditional signature line on a check. In an address printing mode of operation, the print station can be shifted so that addresses are positioned more nearly at the middle of the moving web. As noted above, the tractor feed 17 located near the paper drive motor 22 can also be repositioned to accommodate various width webs.

So long as the two motors 22, 40 are energized at the same time and driven at the same speed, the spacing between adjacent marks on the moving web will be the same. The spacing between markings is dependent upon the circumference of the print roll 32 and more specifically upon the distance the rubber die 42 moves with each rotation of the print roll 32. If this distance, for example, equals 5 inches and the print motor 40 is run continuously as the web is fed through the printing station, signatures or the like will be applied to the web every 5 inches along the web.

The present invention, however, utilizes a drive technique whereby the spacing between adjacent markings can be controlled over a wide range of values. Suppose it is desired that the spacing between adjacent marks be greater than the circumference of the print roll 32. In this situation the paper drive motor 22 can be energized for a certain period of time prior to the energization of the print motor 40. So long as the print motor 40 is unenergized, the two tractor feeds 16, 17 engage the web, driving it through the print station 12 with no marks applied to the web. After a certain time interval, the print motor 40 is energized and the rubber die 42 rotated into contact with the web. The spacing between successive marks becomes greater than the circumference of the print roll 32 and so long as the timing of energization of the two motors is carefully controlled, this spacing can be repeated over and over as the web moves passed the print station 12.

The spacing between successive markings can also be less than the circumference of the print roll 32. To achieve this result, the print motor 40 must be energized before the paper drive motor 22. Thus, the tractor feeds 16, 17 remain stationary as the print motor 40 rotates the die 42 toward the nip between the print roll 32 and the platen roll 30. After a sufficient delay, the paper drive motor 22 energizes the tractor feed causing the web to move through the print station 12 as the die 42 comes in contact with the web. In this situation, the spacing between adjacent markings on the web is less than the circumference of the print roll 32. In a preferred embodiment of the invention, the circumference of the print roll 32 equals 5 inches and the timing between energization of the paper drive motor 22 and the print motor 40 can be controlled so that the minimum spacing between adjacent markings is about 1.8 inches.

The two motors 22, 40 are mounted beneath the housing 24 (FIG. 2) to a bracket 54 coupled to one of the end supports 36. An output shaft from the paper drive motor 22 is directly coupled to the shaft 20 and each rotation of this shaft 20 produces $2\frac{1}{2}$ inches of paper movement. An output shaft from the print motor 40 is coupled to a pulley 56 by a belt 58. Two rotations of the the print motor output shaft produces a single rotation of the pulley 56. Since the circumference of the print roll 32 is 5 inches, however, the speed of the die 42 matches the speed of the web 14 so long as the two motors 22, 40 are operated at the same speed. The two motors 22, 24 are identical and in a preferred embodiment, Panasonic Model No. 57SH-52B6Xa stepper motors are utilized.

Figure 3:
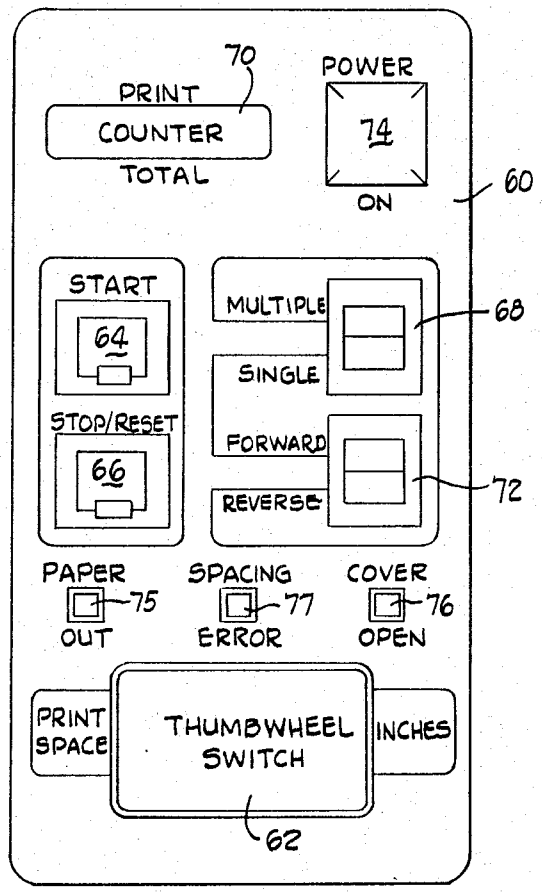
FIG. 3 is a plan view of a control panel through which a user can program the printing machine.

FIG. 3 illustrates a control panel 60 through which a user can program operation of the printing machine 10. The spacing between successive marks is controlled by the setting on a sequence of thumbwheel switches 62 at the bottom of the control panel 60. These switches 62 direct a controller inside the base of the printing machine which in turn controls energization of the two motors 22, 40.

The control panel also includes a start switch 64, a stop switch 66 and a mode switch 68. The mode switch 68 allows the user to select either multiple or single print modes of operation. In a single print mode of operation, the user must actuate the start switch 64 each time the printing machine 10 is to apply a mark to the web. In the multiple mode of operation, once the start switch 64 is actuated, the printing machine 10 continuously applies markings to the moving web 14 at a spacing controlled by the thumbwheel switches 62. Each mark applied by the printing machine is counted on a counter 70.

A paper feed switch 72 allows the user to move the web 14 past the print station 12 in either a forward or reverse direction so long as the start switch 64 has not been actuated. The paper feed switch 72 allows the user to manually position the web with no printing occurring.

The panel 60 also includes four indicators 74–77 which help indicate the status of the printing machine 10. A first indicator 74 is energized when a power on switch 80, located on the base 35 of the printing machine 10, is activated with a key. A second indicator 75 responds to the out-of-paper switch 26. When the switch 26 senses an out-of-paper condition it deactivates the printer in addition to energizing the out-of-paper indicator 75. The cover 11 includes an interlock switch actuator blade 84 which closes an interlock switch 86 when the cover 11 is in place. Should the cover 11 be removed during operation, the interlock switch 86 deactivates the printing machine 10 and in addition energizes the indicator 76.

A final indicator 77 responds to a sensor 88 mounted to the end support 34. As seen in phantom in FIG. 1, the sensor 88 monitors the position of a flag 90 coupled to the drive shaft 38. If energization signals to the print motor 40 do not rotate the flag 90 to a position where the sensor 88 senses its presence, the printing machine 10 is again deactivated and the indicator 77 energized.

Mounted inside the base 35 is a printed circuit board having circuitry for controlling operation of the printing machine 10. This circuitry not only controls energization of the two motors 22, 40 but also receives inputs from the user via the control panel 60 and generates status indicators to apprise the user of the status of the printing machine during operation.

Figure 4:
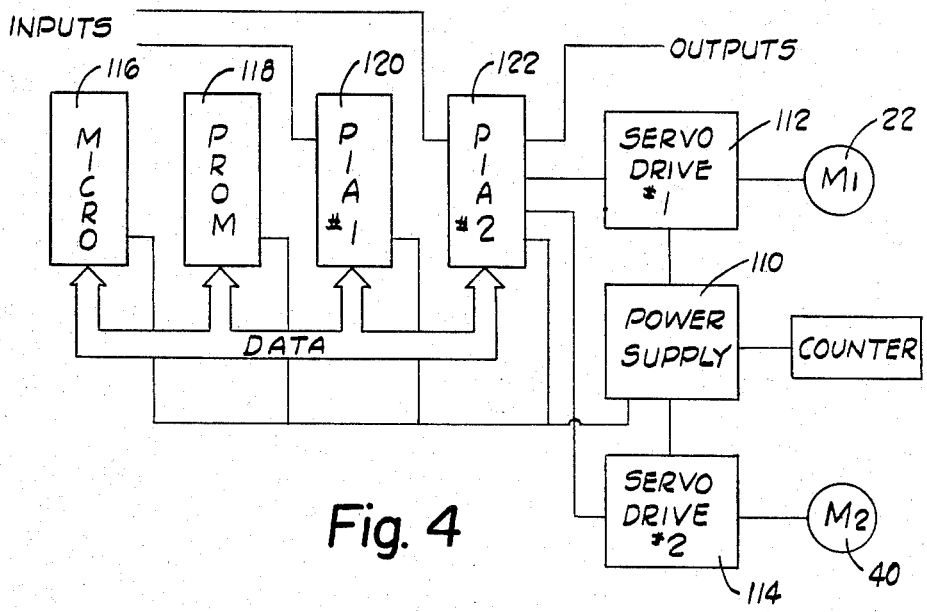
FIG. 4 is a schematic showing the principle electrical components of the printing machine.

A schematic of this circuitry is shown in FIG. 4. The electronics includes a power supply 110, a servo drive 112, 114 for each of the two motors 22, 40 and a programmable controller 116 for controlling the output from the two servo drives 112, 114 as well as for monitoring inputs from the control panel and generating outputs to apprise the user of the status of the printing machine 10.

A preferred programmable controller 116 is a Model 6802 microprocessor available from Motorola. A printer operating system is stored in a memory unit 118 which in the preferred embodiment is a 2716 programmable read only memory unit. Two interface units 120, 122 enable the controller 116 to monitor inputs from the various sensors and/or switches included in the printing machine as well as generate outputs for apprising the user of the status of the printing machine. The preferred interface units 120, 122 are 68A21 peripheral interface adapters.

Figure 5:
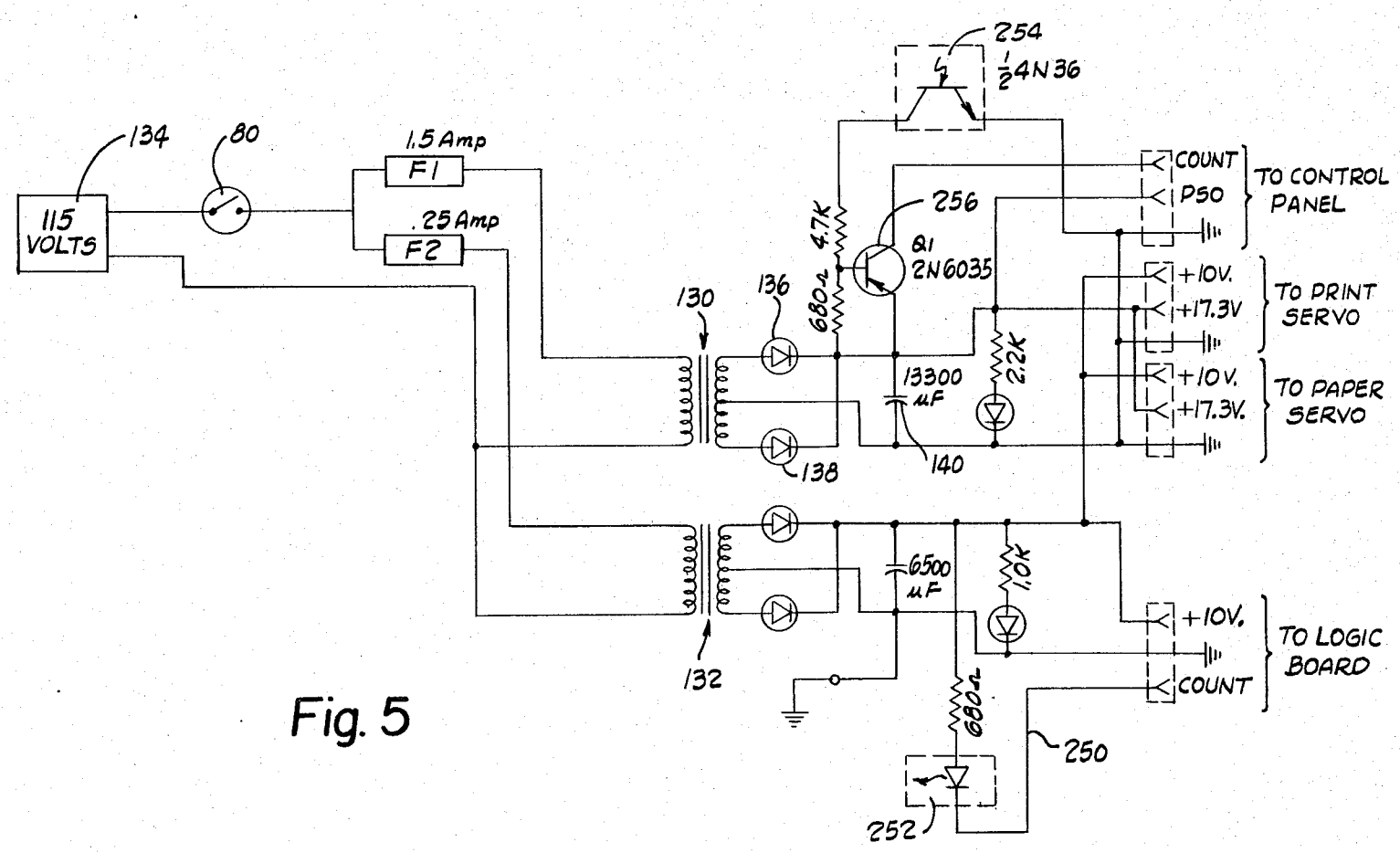
FIG. 5 is a schematic of a system power supply.

Details of the power supply 110 are seen in FIG. 5. Briefly, the power supply 110 generates voltages of 10 and 17.3 volts for the two servo drives 112, 114 and for a power regulator coupled to the microprocessor 116 and its peripheral components 118, 120, 122. Closing of the switch 80 couples two transformers 130, 132 to a standard 115 volt supply 134. A first step down transformer 130 generates a +17.3 signal to the two servo drives 112, 114. The step down voltage output from the first transformer 130 is rectified by a pair of diodes 136, 138 and then filtered by a capacitor 140. The step down voltage from the second transformer 132 is similarly rectified and filtered to generate 10 volts which is then coupled to the servo drive and microprocessor printed circuit board. The ten volt power is first coupled to a voltage regulator (not shown) which furnishes a standard five volts of power for energizing the microprocessor.

Figure 10:
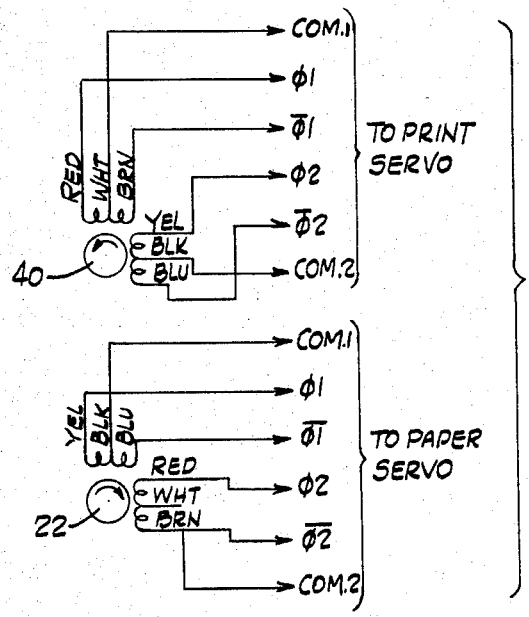
FIG. 10 shows two motor energization connections, each coupled to an associated servo drive circuit.
Figure 11:
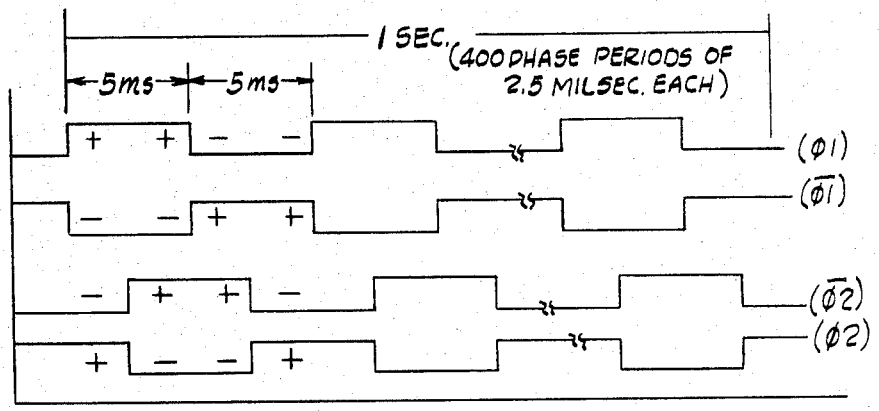
FIG. 11 is a timing diagram for the pulses used to energize the two drive motors.

A primary feature of the microprocessor controlled electronics is the generation of pulses which are transmitted to the two servo drives 112, 114, which in turn energize the two stepper motors 22, 24. The electrical input to the two motors 22, 24 is shown in FIG. 10. A center tap for each of two motor winding is grounded through a five ohm resistor (not shown) while either end of each winding is coupled to an input from its associated servo drive. A series of pulses energizes the windings to create a magnetic field which interacts with a series of permanent magnets on each motor rotor. The pulse repetition rate appearing at the ends of these windings controls the speed at which the motor rotates. A series of waveforms for energizing the two motors 22, 40 is shown in FIG. 11. These waveforms are generated by the microprocessor 116 through outputs from the second interface unit 122. The labeling of the FIG. 11 waveforms (Ø1, Ø2 etc.) corresponds to the input labeling to the motors 22, 40 in FIG. 10 which in turn corresponds to the labeling of these signals in FIGS. 7 and 9.

The width of each pulse in FIG. 11 is approximately 5 milliseconds. Phasing of the two pulse trains is such that a change of phase occurs at approximately 2.5 millisecond intervals. Two hundred changes of phase will cause each motor to rotate once so that for the energization sequence shown in FIG. 11, the motor will rotate two revolutions per second to produce a web speed of 5 inches per second. The relative timing of Ø1 and Ø2 in FIG. 11 produces a forward rotation to the motors 22, 40. By reversing the relationship so that Ø2 leads rather than lags Ø1 by 90° the direction of motor rotation is reversed.

Each motor has its own servo drive circuit (FIG. 9) for energizing the motor windings. The two servo drive circuits 112, 114 are the same, so that only one has been shown in detail. The circuit includes 4 optically coupled transistors 150*a–d* which are controllably turned on and off by infra-red light emitting diodes (L.E.D.) 152*a–d*. The L.E.D.'s 152*a–d* are in turn connected to outputs from the interface unit 122 (see FIG. 7) which will be discussed in conjunction with the microprocessor circuitry. Each of the transistors 150*a–d* is turned on and off in an identical fashion so the function of only one of these transistors need be discussed in detail.

Figure 9:
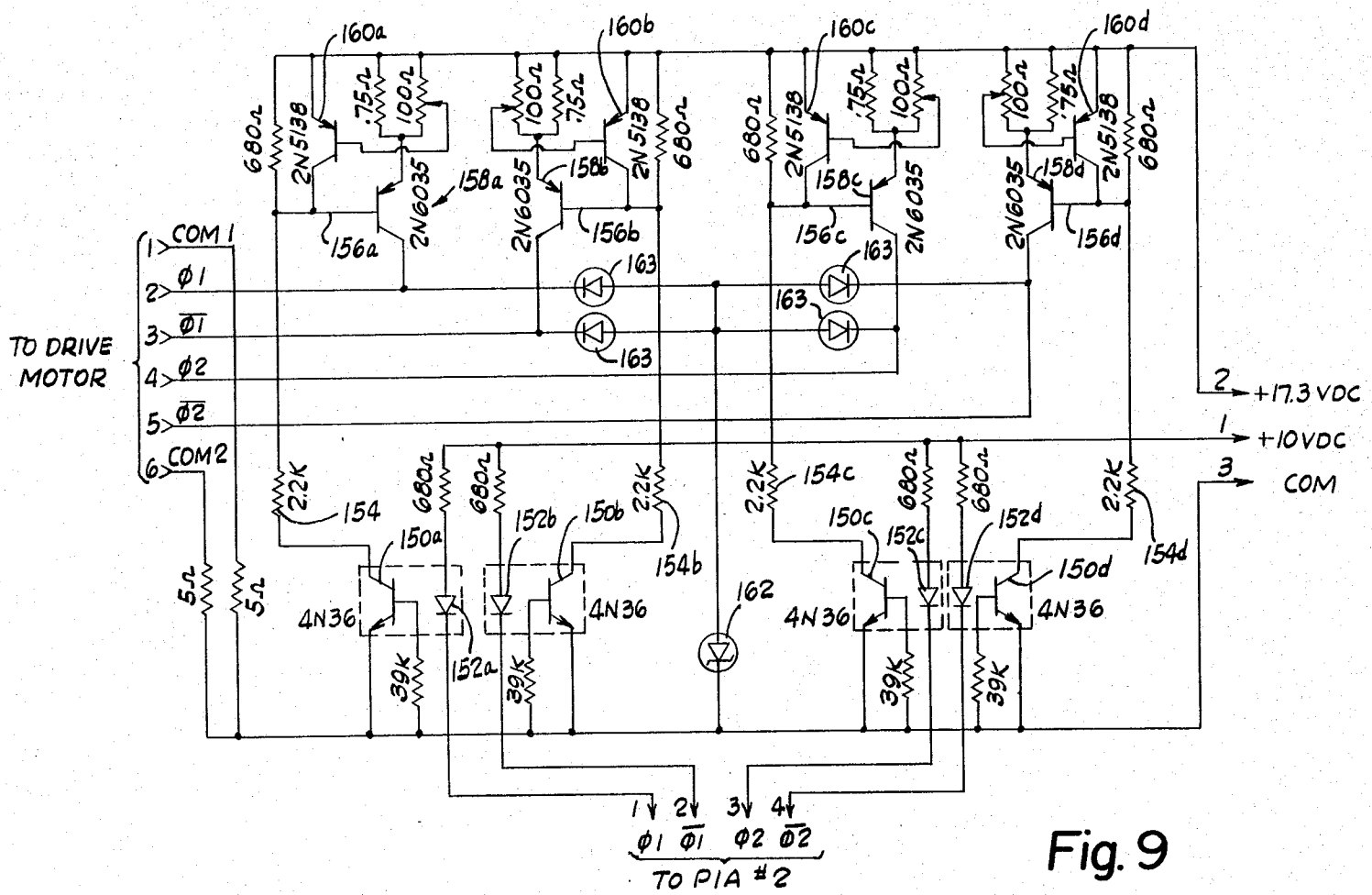
FIG. 9 is a servo drive circuit used in energizing one of two motors used in the printing machine.

When any of the servo drive inputs (for example Ø1) goes low in response to an output from the interface unit 122, current passes through the diode coupled to this output thereby energizing its associated transistor If Ø 1 goes low, the left most transistor 150*a* in FIG. 9 will be turned on causing current to flow through a 2.2 kilohm resistor 154*a* dropping the voltage at a base input 156*a* to a PNP transistor 158*a*. The negative input at the base 156*a* turns on this PNP transistor causing a voltage pulse of about 12 volts to appear at output Ø1 to the drive motor. The operation of the other transistors is the same.

It should be noted that when the input $\overline{\text{Ø1}}$ from the interface unit 122 is low, its inverse input Ø1 is high so that no current will pass through its associated diode 152*b* and its transistor will remain turned off and no input 156*b* will be transmitted to the base input of its associated PNP transistor 158*b*.

Four additional PNP transistors 160*a–d* limit the current through the first four transistors 158*a–d*. The value of a 100 ohm variable resistor is adjusted so that these transistors 160*a–b* "turn on" when a current of 1.2 amps passes through its associated transistor 158*a–d*.

When the transistor 158 is turned off in response to a change in the output from the controller, the energization of the motor winding is terminated. The magnetic field produced by this winding collapses which in turn produces a negative pulse which is transmitted back to the servo drive circuit. If this negative pulse is allowed to reach too large a magnitude, the voltage across the PNP transistor 158*a* can exceed the 60 volt breakdown voltage for that transistor. Accordingly, a zener diode 162 (FIG. 9) is connected through steering diodes 163 between the collector of the PNP transistor 158 and ground. Any negative voltage of 24 volts or greater will activate the zener diode shunting the signal to ground and thereby avoiding breakdown of the PNP transistors 158*a–d*. This also allows more rapid collapse and re-energization of the motor windings field, resulting in higher attainable motor speeds.

When the power on switch 80 is actuated, 5 volt power (VCC) is supplied to the microprocessor, the memory, and the two interface units 120, 122. This +5 volt power is also coupled to a reset circuit 170 (FIG. 8) which transmits the reset input to the microprocessor (pin number 40 on the 6802 microprocessor). When power is initially applied to the reset circuit 170, a 9.4 kilohm and 330 ohm resistor in combination with a 10 microfarad capacitor produce a delay in the application of the 5 volt input to one of two inputs to a nand gate 172. Until the 10 microfarad capacitor charges to a 1.4 volt value, the nand gate 172 generates a high output which turns on a NPN transistor 174. This momentarily provides a low reset input to the microprocessor thereby providing a power on reset feature to the system. A stop/reset switch 66 on the console 60 also, of course, resets the processor 116 by grounding one input to the nand gate 172.

Figure 6:
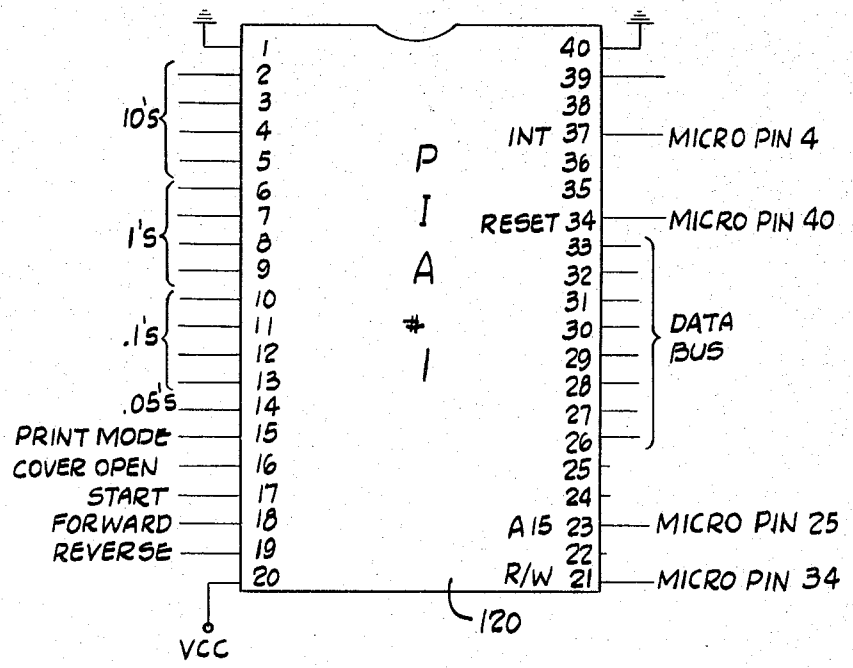
FIG. 6 is a schematic of an input circuit included in the FIG. 4 schematic.
Figure 7:
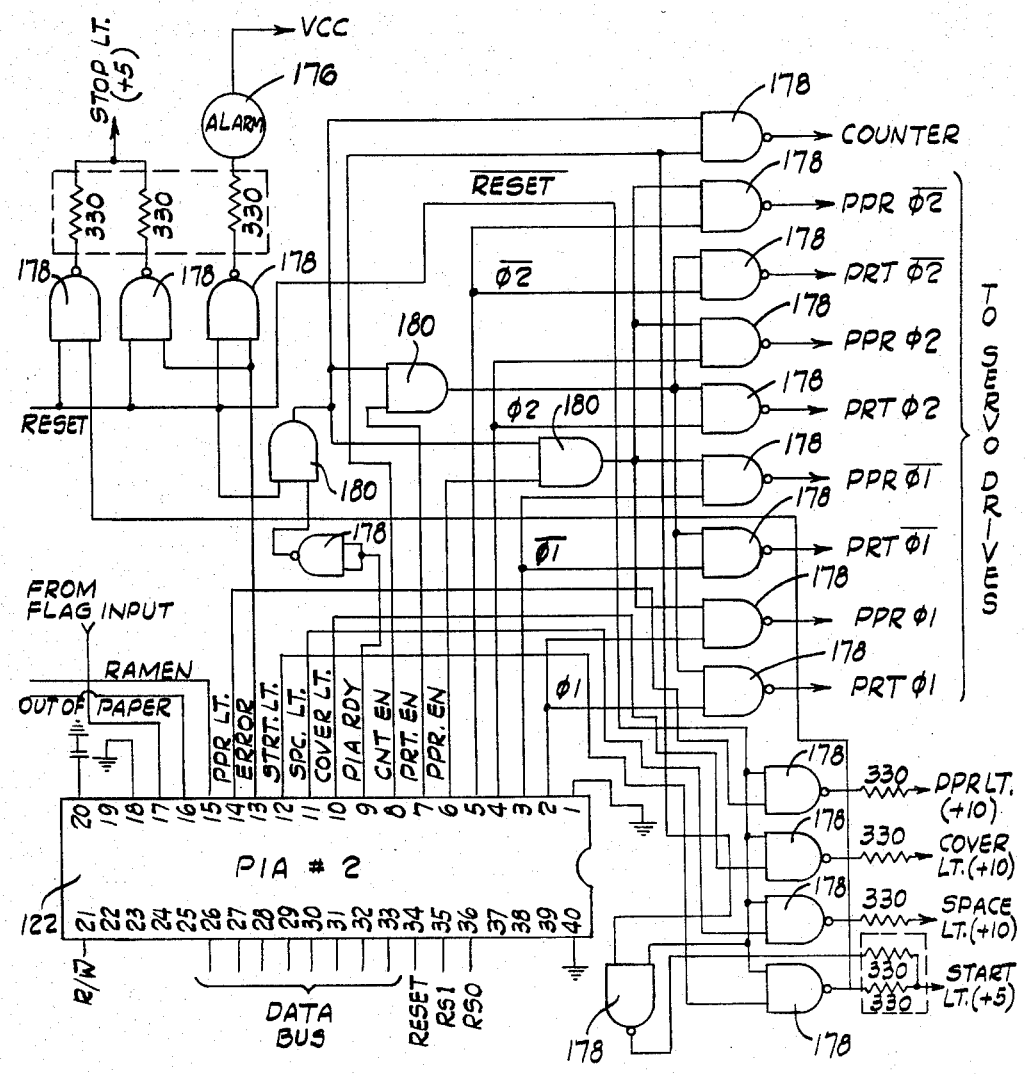
FIG. 7 is a schematic of an output circuit included in the FIG. 4 schematic.
Figure 8:
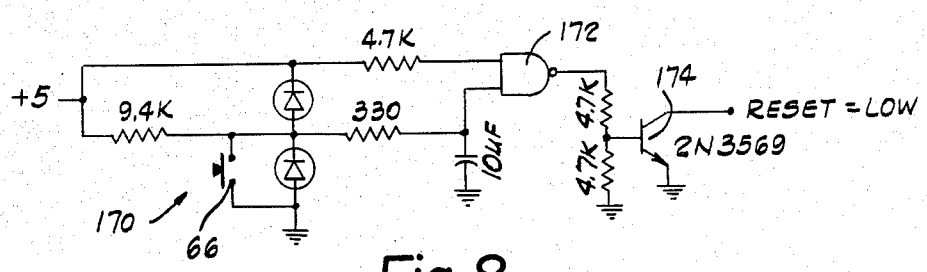
FIG. 8 is a reset circuit to restart the software stored in a read only memory shown in FIG. 4.

FIGS. 6–8 document the inputs and outputs to the micropressor peripheral interface adapters 120, 122. A controller operating system stored in the memory unit 118 performs an algorithm for sensing the inputs to the two peripheral units 120, 122 (FIGS. 6 and 7) and at appropriate intervals generates outputs from the second interface unit 122.

Table 1 below illustrates the various inputs to the microprocessor controlled system as well as indicating the pin location of these inputs on the two interface units 120, 122.

TABLE 1

| INPUT | LOCATION | SOURCE |
|---|---|---|
| (1) Spacing | PIA #1 Pins 2–14 | Thumbwheel Switches |
| (2) Print Mode | PIA #1 Pin 15 | Print Mode Switch |
| (3) Cover Open | PIA #1 Pin 16 | Interlock Switch |
| (4) Start | PIA #1 Pin 17 | Start Switch |
| (5) Forward | PIA #1 Pin 18 | Paper Feed Switch |
| (6) Reverse | PIA #1 Pin 19 | Paper Feed Switch |
| (7) No Paper | PIA #2 Pin 16 | Out-Of-Paper Sensor |
| (8) Shaft Orientation | PIA #2 Pin 17 | Shaft Flag Sensor |

Receipt by the microprocessor 116 of a reset signal causes the microprocessor to begin its control algorithm for monitoring and controlling the printing machine. During this algorithm, the microprocessor sequentially polls the various input ports on the two interface units to determine the status of the various inputs. The inputs have a certain hierarchy which will be discussed in conjunction with the FIG. 12 flow chart of the microprocessor algorithm.

Listed below in Table 2 is a series of outputs generated by the microprocessor at the second 122 of the 2 interface units.

TABLE 2

| OUTPUT | LOCATION | CONTROL |
|---|---|---|
| (1) Paper Light | PIA #2 Pin 14 | Out-Of-Paper Indicator |
| (2) Start Light | PIA #2 Pin 12 | Printing Indicator |
| (3) Cover Light | PIA #2 Pin 10 | Cover Open Indicator |
| (4) Counter | PIA #2 Pin 8 | Counter |
| (5) Print Enable | PIA #2 Pin 7 | Enable AND Gates |
| (6) Paper Enable | PIA #2 Pin 6 | Enable AND Gates |
| (7) Ø1 | PIA #2 Pin 2 | Motor Drive |
| (8) $\overline{Ø1}$ | PIA #2 Pin 3 | Motor Drive |
| (9) Ø2 | PIA #2 Pin 4 | Motor Drive |
| (10) $\overline{Ø2}$ | PIA #2 Pin 5 | Motor Drive |
| (11) Error | PIA #2 Pin 13 | Shaft Orientation Bad |
| (12) Ram Enable | PIA #2 Pin 15 | Micro Internal Ram |

The outputs from the second interface unit 122 energize the various indicators discussed previously as well as activate the counter and energize an alarm 176. Perhaps the most crucial of the outputs generated by the interface unit 122 are the motor energization signals (Ø1, Ø2 etc.) (see FIG. 11) coupled to the servo drive for the print and paper motor.

It should be appreciated that the two peripheral interface units 120, 122 operate in a similar manner and can be utilized as either input or output ports for the microprocessor 116. In an input mode, the microprocessor selectively polls the input pins to the unit. to obtain status information. In an output mode, the microprocessor generates data along its data bus which is transmitted to the particular peripheral interface unit and stored in that units memory. The output status of the various pins from that units output ports will remain unchanged until a control signal from the microprocessor dictates such a change. Thus, for the microprocessor to activate the alarm 176 it generates a high output from pin 13 to produce a low output from a nand gate 178 coupled to the alarm 176. The control logic for various other of the outputs from the peripheral interface unit 122 should be readily apparent to one skilled in the art. By examining the input to the various nand gates 178, the appropriate pin energization sequence for generating the various indicator and/or motor energization signals should be apparent to one skilled in the art.

Since the motor energization signals are crucial to operation of the printing machine 10, it is instructive to examine how one of these signals is generated by the interface unit 122. The signal labeled PPRØ1, for example, is seen at the right of FIG. 7 to come from a nand gate 178 having two inputs. The designation PPRØ1 means that this signal energizes the paper motor 22 rather than the print motor 40. The nand gate's two inputs dictate when PPRØ1 goes low. One input is seen to be coupled to an output from PIA#2 122 at pin 2 so that when this pin goes high, half the criteria for generating a low output from PPRØ1 has been met. The other input to the PPRØ1 nand gate will be high if and only if (a) the print enable pin (pin #7, PIA #2) goes high, (b) no reset signal is received, and (c) a PIA ready signal (pin #9, PIA #2) has been set. To generate a 5 millisecond pulse width signal for PPRØ1 the microprocessor 116 satisfies conditions a and c for 5 millisecond and then causes pin #2 on PIA #2 to go low. The other motor energization signals PPRØ2 etc. are generated in a similar manner.

Figure 12:
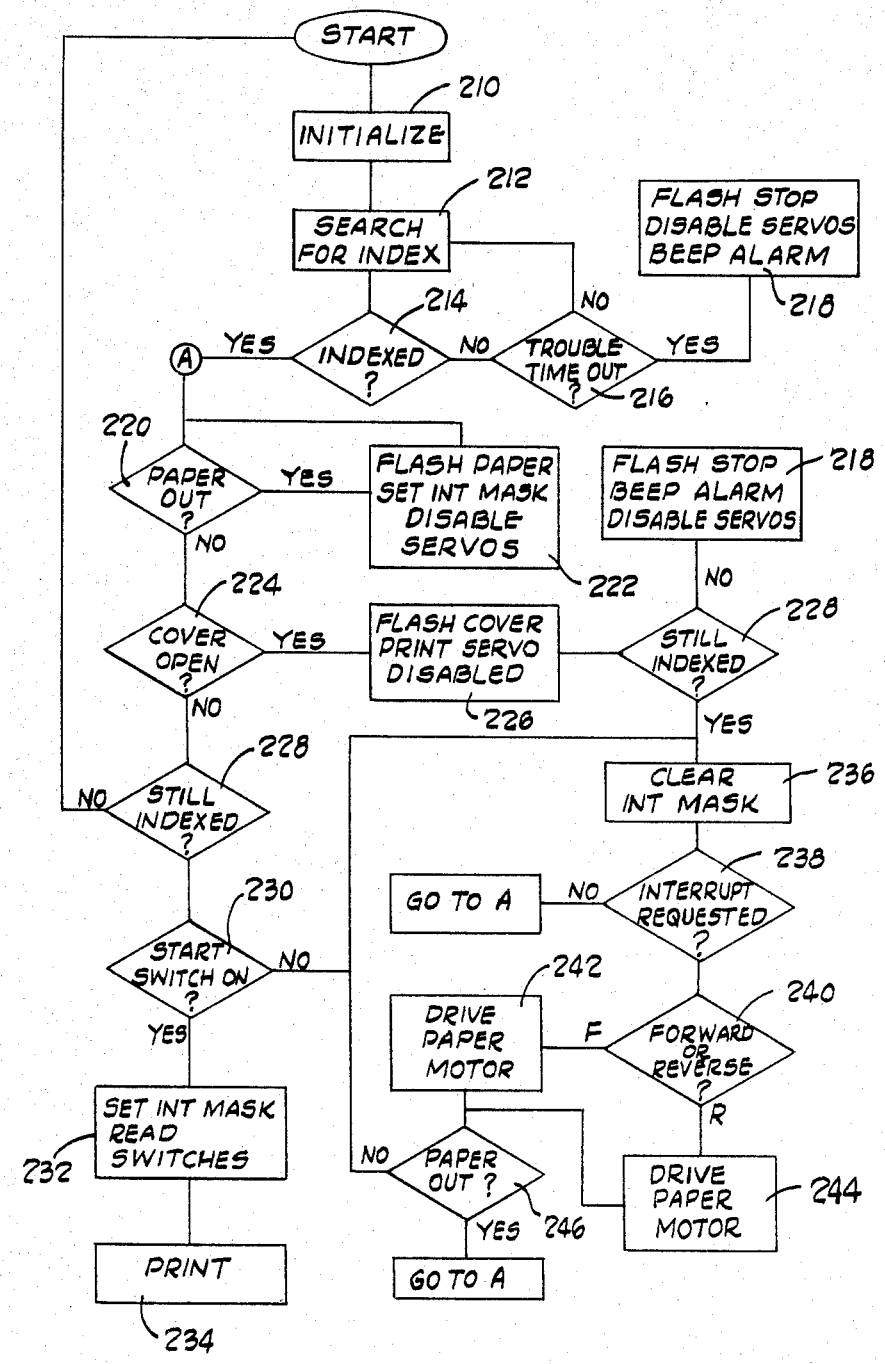
FIG. 12 is a flowchart showing a sequence of steps a programmable controller performs in controlling operation of the printing machine.

FIG. 12 is a flow diagram of the control algorithm that the microprocessor 116 performs in controlling operation of the printing machine 10. As mentioned above at power up, the reset pin (pin 40) on the microprocessor is momentarily activated and this step corresponds to the start position in the FIG. 12 flow chart.

The microprocessor first performs a series of initialization steps 210 when the power is first turned on. These initialization steps include the setting of an interrupt mask so that the microprocessor responds to no externally generated interrupts. The microprocessor also checks the status of the memory, both in the programmable read only memory, and its own internal ram space. At power-up the output pins on the two peripheral interface units 120, 122, are high so the microprocessor 116 must set the output pins on these two units during the initialization phase. In this regard, it is seen that pin 9 of the second peripheral interface unit 122 is coupled to a nand gate 178 which in turn is coupled to an and gate 180. This and gate 180 produces a high output only when pin number 9 of the second peripheral interface unit goes low. Thus, until the microprocessor causes this pin to go low, all other outputs from the various nand gates 178 in FIG. 7 are deactivated. In this way, the power-on high status of the various output pins on this second peripheral interface unit generate no outputs for motor energization.

At the next step 212, the microprocessor energizes the print drive motor 40 to properly position the flag indicator 90 so the sensor 88 senses its presence. At the next step 214, the microprocessor polls pin 17 from the second peripheral interface unit to see if the print motor has moved the flag into a position where the sensor 88 sees it. If the flag has not yet moved around to the sensor position, the microprocessor calculates at step 216 whether the time it has been searching for the flag exceeds a predetermined limit. If its search sequence has not exceeded this limit, the microprocessor again checks for the presence of the flag and continues to do so until either the flag appears or the predetermined time has expired. Should the time expire, the microprocessor will flash the spacing error indicator 77, disable the servos, and sound the alarm 176. These steps 218 are only taken if the motor does not cause the desired movement in the flag so that if they do occur the user should check to see what is malfunctioning to prevent the print motor from driving the shaft into position.

When the index is sensed, the print motor 40 has rotated the drive shaft 38 to a position so that the rubber die 42 is oriented toward the back of the printing machine 10 and neither contacts the ink roll 44 nor the platen roll 30. Once the microprocessor has succeeded in orienting the drive shaft 38, it next checks at a step 220 to see if paper has been added to the machine. This step is accomplished by polling pin number 16 on the second peripheral interface unit (see Table 1) to determine whether the switch 26, mounted to the tractor feed 16, senses paper passing to the print station. If no paper is in position, the out-of-paper indicator 75 is turned on, the microprocessor interrupts are masked 222 to prevent the user from trying to move paper either forward or backward, and the drive servo to the motors are deenergized. The microprocessor will continue to loop through the paper checking step 220 so long as no paper is added and the power is turned on.

When paper is added, the user inserts the web 14 into the paper guide 28 until the desired marking position (signature line, etc.) aligns with two marks 221 on either side of the guide 28. From this position, if both motors are actuated at the same time, the die 42 will print at the indicated position. On subsequent energizations, of course, suitable delays may be necessary to insure proper spacing between marks on the web.

Once paper is inserted into the printing machine 10, the next step 224 the microprocessor performs is to check to see if the cover 11 has been left open. If the cover is open, the indicator 76 is energized and the print servo disabled by generating a low output from pin 7 of the #2 peripheral interface unit. These steps 226 insure that no printing can occur with the cover open to thereby safegard against inadvertant placing of the user's fingers into the print mechanism but does allow the user to drive the paper either forward or backward with the manual paper feed switch 72.

If the cover has been open, it is possible that the rubber die 42 has been changed and that in doing so the user has misoriented the drive shaft 38. At a next step 228 therefore, the position of the flag 90 is again checked and if it has been moved out of position the printing machine is re-initialized. If the orientation of the drive shaft remains appropriate, the microprocessor then determines whether the paper feed switch 72 has been actuated by the user.

Even if the cover is closed, the microprocessor again checks 228 to see if the index position of the drive shaft is appropriate and if it is not it returns the algorithm to the start location to reposition the drive shaft 38. If the drive shaft orientation is all right, the microprocessor then senses at step 230 whether the start switch 64 has been closed. If the start switch has been closed, the interrupt masks set and the microprocessor proceeds at step 232 to read the desired spacing at pins 2–14 on the first peripheral interface unit. These inputs are coupled to the thumbwheel switches 62 which the user has adjusted to a desired print spacing. Once the switch settings have been read, the microprocessor enters a print routine 234 for controllably energizing both print and paper drive motors.

The microprocessor can enter the manual paper feed mode of operation under either of two circumstances. As noted above, if the cover has been opened and the flag 90 carried by the drive shaft 38 remains indexed in relation to the sensor 88, the microprocessor clears the interrupt masks at a step 236 and determines at the next step 238 whether an interrupt has been requested from one of the peripheral interface units. These two steps are also performed if the start switch has not been actuated when the microprocessor, at step 230, polls pin 17 of the first peripheral interface unit (see Table 1) to see if the start switch has been pressed.

The manual paper feed switch 72 produces inputs at pins 18 (forward) and 19 (reverse) of the first peripheral interface unit 120. These pins are processed as interrupt requests by the controller 116. When the interrupts are masked, therefore, the manual feed switch can have no effect. When the interrupt masks are cleared, receipt of either input (forward or reverse) causes the controller 116 to jump to an interrupt request routine where PIA #1 is polled to see which direction the paper is to be fed.

Returning to the FIG. 12 flowchart, if no interrupt is requested, the microprocessor branches to point A in the flowchart and again polls the various sensors to a determine status of the printing machine. If an interrupt is requested, the microprocessor determines at step 240 which direction of paper movement is desired. If pin 18 on the first peripheral interface unit goes low in response to the user toggling the paper feed switch 72 in a forward position, the microprocessor energizes the paper motor 22 to move the paper in a forward direction (step 242 in the flowchart) and if pin number 19 on the first peripheral interface unit goes low in response to the user toggling the paper feed switch 72 in the reverse orientation, the microprocessor energizes the motor 22 to reverse the direction of paper movement (step 244).

Either forward or reverse movement of the paper can move the edge of the paper to a position so that the sensor switch 26 connected to the tractor feed 16 no longer senses the paper. At a step 246, pin 16 of the second peripheral interface unit (see Table 1) is polled to determine if driving of the paper in either the forward or reverse direction has caused the leading or trailing edge of the paper to pass the out-of-paper switch 26. If so, the microprocessor again branches to the point labeled A in the FIG. 12 flow chart to cause the out-of-paper indicator to be energized and the servos disabled. If the paper remains over the switch 26, the microprocessor 116 branches to the beginning of the paper drive routine and again determines if an interrupt has been requested by the user's activation of the paper feed switch 72.

The print routine performed by the microprocessor operates in one of two modes. In the single print mode, the user must activate the start button each time a print is to be made. The microprocessor then drives the paper and print motors 22, 40 to apply a single mark on the paper at the spacing indicated by the thumbwheel switch setting. In the multi-print mode of operation, the motors 22, 40 are energized continuously until the user hits the stop/reset button 66 or the machine runs out of paper.

During single or multiple print mode of operation, the microprocessor energizes pin number 8 on the second peripheral interface unit 122 (FIG. 7) with each rotation of the print roll 32 so the user can be apprised. of how many marks have been applied to the moving paper. Pin #8 going high causes the topmost nand gate 178 in FIG. 7 to produce a low output to an input 250 on the power suply circuit board (see FIG. 5). This in turn causes an LED 252 to conduct which causes a phototransistor 254 to turn on. When this transistor 254 conducts, a base input to a PNP transistor 256 drops which turns on the transistor 256 thereby activating the counter 70 on the control panel 60.

The speed of the motors can be varied by changing the pulse repetition rate of the signals transmitted to the servo drive. It has been determined that the particular stepper motors used in the preferred embodiment of the invention generate their maximum torque output at a pulse repetition rate of approximately 400 cycles per second. This rate is used by the microprocessor whenever the print motor 40 is initially energized so that the rotational inertia of the print roll 32 can most easily be overcome by the motor 40.

Once rotation begins, however, the pulse repetition rate can be speeded up and in particular, is typically speeded to a rate of approximately 800 pulses per second. The speed of the paper motor 22 is adjusted in a similar manner. The only constraint on the speed of the two motors is that the speed of the two must match when the print die 42 contacts the paper.

To illustrate this feature, consider a situation where the print spacing is to be much greater than the circumference of the print roll 32. In that circumstance, the paper drive motor 22 is energized prior to the energization of the print motor 40. The paper motor 22 is initially energized at a rate of 400 pulses per second which is then ramped up to a maximum value of 800 pulses per second then continues until the paper has been driven to a point where the print motor 40 must be actuated. Just prior to the energization of the print motor, since both motors are to be driven at the same frequency, the paper motor is ramped down to 400 pulses per second so that when the print motor is enabled, it produces its maximum torque to overcome the rotational inertia of the print roll 32. Once rotation begins, the speed of both motors can again be ramped up until just before the die 42 rotates into contact with the paper. Both motors are ramped down to allow maximum print motor torque during the actual print contact. Then the print motor is deenergized and the paper drive motor continues to rotate paper through the print station until the next print motor actuation is to occur.

During the print cycle, the position of the flag 90 at the end of the drive shaft 38 is continually monitored to insure that motor energization by the microprocessor results in shaft rotation. If this is not the case, the appropriate alarms and lights are energized and the drive servos deactivated.

The printing machine 10 can be used as one station of a multi-station processing system. In such a system it is envisioned that a third peripheral interface unit (not shown) would be added to the microprocessor system shown in FIG. 4, to allow the microprocessor 116 to communicate with other processing stations which, for example, might include a programmable controller for a word processing system. This additional interface is used in implementing an optional feature which terminates printing operation after a desired number of prints and can also be utilized to expand the capability of the printing machine by adding sensors and/or controls not envisioned in the present application.

It should be appreciated that the present invention has been described with a degree of particularity. It is possible, however, that various design modification would be apparent to one skilled in the art. It should be appreciated, for example, that although the thumbwheel switch settings for the preferred embodiment are in English units, they could be easily modified to allow the user to input the desired spacing in metric units. It should be apparent therefore, that although the invention has been described with a degree of particularity, it is the intent that all modifications, alterations, or changes falling within the spirit or scope of the appended claims be protected.

We claim:

1. Printing apparatus for applying an ink marking at selected intervals on a moving web of paper comprising:

tractor drive means including means for engaging said web;

a first drive shaft rotatably mounted to a printer housing and coupled to said tractor drive for moving the paper along a path of travel to a print station;

a first motor for rotating said first drive shaft to move said web toward said print station;

a print cylinder having a rubber die mounted to said cylinder's exterior;

a second drive shaft to which said cylinder is mounted, said second drive shaft rotatably mounted to said printer housing;

a second motor coupled to said second drive shaft for selectively rotating said print cylinder to cause said die to strike said web;

a backing roller over which said web moves in the vicinity of said print cylinder which forms a nip with said die;

means for inking said die each time said cylinder rotates about its axis of rotation so that said die applies said marking to the web each time it rotates into contact with said web; and circuitry coupled to said first and second motors to energize said motors at coordinated times to control the spacing between successive marks on said web.

2. The apparatus of claim 1 wherein said circuitry comprises a programmable controller connected to an input through which a user enters the spacing between marks, said controller operative to energize said motors in a coordinated sequence and speed to cause said die to have substantially the same speed as said web when it rotates into contact with said web.

3. The apparatus of claim 1 which further comprises a sensor mounted to said tractor drive for sensing when a trailing edge of said web passes said tractor drive.

4. The apparatus of claim 1 which further comprises means for sensing the orientation of said second drive shaft to insure said second motor is properly energized by said circuitry.

5. The apparatus of claim 1 wherein said means for inking comprises an inking roller rotatably mounted to a support shaft oriented parallel to said drive shaft such that each rotation of said cylinder brings said die into contact with the inking roller.

6. The apparatus of claim 5 wherein said inking and print cylinders frictionally engage said drive and support shafts but can be manually repositioned along those shafts to adjust the position said marking is applied across the width of said web.

* * * * *

UNITED STATES PATENT AND TRADEMARK OFFICE

CERTIFICATE OF CORRECTION

PATENT NO. : 4,538,515

DATED : September 3, 1985

INVENTOR(S) : John Tymkewicz et al.

It is certified that error appears in the above-identified patent and that said Letters Patent is hereby corrected as shown below:

Column 7, line 60, insert a --.-- after "transistor".

Column 8, line 1, there should be no line over "Ø1";

line 2, there should be a line over "Ø1".

Column 10, line 39, change "an and" to --a nand--.

Column 12, line 59, delete the period after "apprised";

Signed and Sealed this

*Tenth* Day of *December 1985*

[SEAL]

*Attest:*

DONALD J. QUIGG

*Attesting Officer*

*Commissioner of Patents and Trademarks*